US010352335B2

(12) United States Patent
Fukuda et al.

(10) Patent No.: US 10,352,335 B2
(45) Date of Patent: Jul. 16, 2019

(54) HYDRAULIC SYSTEM OF WORK MACHINE

(71) Applicant: Kubota Corporation, Osaka-shi (JP)

(72) Inventors: Yuji Fukuda, Sakai (JP); Kazuyoshi Arii, Sakai (JP); Ryohei Sumiyoshi, Sakai (JP); Keigo Honda, Sakai (JP)

(73) Assignee: KUBOTA CORPORATION, Osaka-Shi (JP)

( * ) Notice: Subject to any disclaimer, the term of this patent is extended or adjusted under 35 U.S.C. 154(b) by 260 days.

(21) Appl. No.: 15/387,569

(22) Filed: Dec. 21, 2016

(65) Prior Publication Data

US 2017/0175779 A1 Jun. 22, 2017

(30) Foreign Application Priority Data

Dec. 22, 2015 (JP) ..... 2015-249863
Sep. 27, 2016 (JP) ..... 2016-188001

(51) Int. Cl.
*F15B 11/16* (2006.01)
*E02F 9/22* (2006.01)
*E02F 3/34* (2006.01)

(52) U.S. Cl.
CPC ..... *F15B 11/16* (2013.01); *E02F 3/3414* (2013.01); *E02F 9/2292* (2013.01); (Continued)

(58) Field of Classification Search
CPC ..... F15B 11/16; F15B 11/162; F15B 11/163; F15B 11/165; F15B 2211/3059; (Continued)

(56) References Cited

U.S. PATENT DOCUMENTS 3,303,753 A * 2/1967 McCay, Jr. ..... F15B 11/16 91/520
3,916,624 A * 11/1975 Machens ..... E02F 9/0841 60/394
4,022,023 A * 5/1977 Inaba ..... F04B 49/002 60/445
4,367,624 A * 1/1983 Ogata ..... E02F 3/844 60/484

(Continued)

FOREIGN PATENT DOCUMENTS

JP 56-033371 U 4/1981
JP 2000-136803 5/2000
JP 2010-270527 12/2010

OTHER PUBLICATIONS

Japanese Office Action for corresponding JP Application No. 2015-249863, dated Nov. 28, 2018 (w/ English machine translation).

*Primary Examiner* — F Daniel Lopez
*Assistant Examiner* — Dustin T Nguyen
(74) *Attorney, Agent, or Firm* — Mori & Ward, LLP

(57) ABSTRACT

A hydraulic system of a work machine includes a first hydraulic actuator, a first control valve, a first oil passage, a second hydraulic actuator, a second control valve, a second oil passage, and a bypass oil passage. The first control valve is connected to the first hydraulic actuator to control the first hydraulic actuator. The first oil passage is connected to the first control valve to supply hydraulic oil to the first control valve. The second control valve connected to the second hydraulic actuator to control the second hydraulic actuator. The second oil passage connects the second control valve and the first hydraulic actuator via the first control valve. Hydraulic oil returning from the first hydraulic actuator to the first control valve is to be supplied to the second control valve through the second oil passage. The bypass oil passage connects the first oil passage and the second oil passage.

12 Claims, 6 Drawing Sheets

(52) U.S. Cl.
CPC ..... *F15B 2211/3059* (2013.01); *F15B 2211/3116* (2013.01); *F15B 2211/3122* (2013.01); *F15B 2211/3127* (2013.01); *F15B 2211/3144* (2013.01); *F15B 2211/40507* (2013.01); *F15B 2211/40592* (2013.01); *F15B 2211/41509* (2013.01); *F15B 2211/71* (2013.01); *F15B 2211/7142* (2013.01)

(58) Field of Classification Search
CPC ..... F15B 2211/3116; F15B 2211/3122; F15B 2211/3127; F15B 2211/3133; F15B 2211/31541; F15B 2211/31547; F15B 2211/31552; F15B 2211/315; F15B 2211/41509; F15B 13/021; F15B 13/022; E02F 3/3414; E02F 9/2292
USPC ..... 60/424, 461, 468
See application file for complete search history.

(56) References Cited

U.S. PATENT DOCUMENTS

| | | | | |
|---|---|---|---|---|
| 4,526,085 | A * | 7/1985 | Morizur | E02F 9/2239 91/6 |
| 4,622,886 | A * | 11/1986 | Imada | E02F 3/433 91/437 |
| 6,871,575 | B2 * | 3/2005 | Korogi | E02F 9/2217 137/636.2 |
| 7,549,241 | B2 * | 6/2009 | Ioku | E02F 3/432 37/348 |
| 7,895,833 | B2 * | 3/2011 | Kajita | E02F 9/2225 60/424 |
| 9,410,560 | B2 * | 8/2016 | Coombs | F15B 11/16 |
| 9,429,174 | B1 * | 8/2016 | Schuh | E02F 9/2203 |
| 2013/0318958 | A1 * | 12/2013 | Coombs | F15B 11/16 60/459 |

* cited by examiner

HYDRAULIC SYSTEM OF WORK MACHINE

CROSS-REFERENCE TO RELATED APPLICATIONS

The present application claims priority under 35 U. S. C. § 119 to Japanese Patent Application No. 2015-249863, filed Dec. 22, 2015, Japanese Patent Application No. 2016-188001, filed Sep. 27, 2016. The contents of these applications are incorporated herein by reference in their entirety.

BACKGROUND OF THE INVENTION

Field of the Invention

The present invention relates to a hydraulic system of a work machine.

Discussion of the Background

Conventionally, JP 2010-270527 A is known as a hydraulic system of a work machine. The work machine disclosed in JP 2010-270527 A includes a boom, a bucket, a boom cylinder that actuates the boom, a bucket cylinder that actuates the bucket, a reserve actuator that actuates a reserve attachment, a first control valve that controls stretch and contraction of the boom cylinder, a second control valve that controls stretch and contraction of the bucket cylinder, and a third control valve that actuates the reserve actuator.

SUMMARY OF THE INVENTION

According to one aspect of the present invention, a hydraulic system of a work machine includes a first hydraulic actuator, a first control valve, a first oil passage, a second hydraulic actuator, a second control valve, a second oil passage, and a bypass oil passage. The first control valve is connected to the first hydraulic actuator to control the first hydraulic actuator. The first oil passage is connected to the first control valve to supply hydraulic oil to the first control valve. The second control valve connected to the second hydraulic actuator to control the second hydraulic actuator. The second oil passage connects the second control valve and the first hydraulic actuator via the first control valve. Hydraulic oil returning from the first hydraulic actuator to the first control valve is to be supplied to the second control valve through the second oil passage. The bypass oil passage connects the first oil passage and the second oil passage.

According to another aspect of the present invention, a hydraulic system of a work machine includes a hydraulic pump, a first hydraulic actuator, a second hydraulic actuator, a first control valve, a second control valve, a second oil passage, a discharge oil passage, and a throttle. The hydraulic pump is to supply hydraulic oil. The first control valve is connected to the hydraulic pump and the first hydraulic actuator to control the first hydraulic actuator. The second control valve is connected to the second hydraulic actuator to control the second hydraulic actuator. The first control valve is provided between the hydraulic pump and the second control valve. The second oil passage connects the second control valve and the first hydraulic actuator via the first control valve. Hydraulic oil returning from the first hydraulic actuator to the first control valve is to be supplied to the second control valve through the second oil passage. The discharge oil passage is branched from the second oil passage. The hydraulic oil returning from the first hydraulic actuator is to be discharged through the discharge oil passage. The throttle is provided in the discharge oil passage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Figure 1:
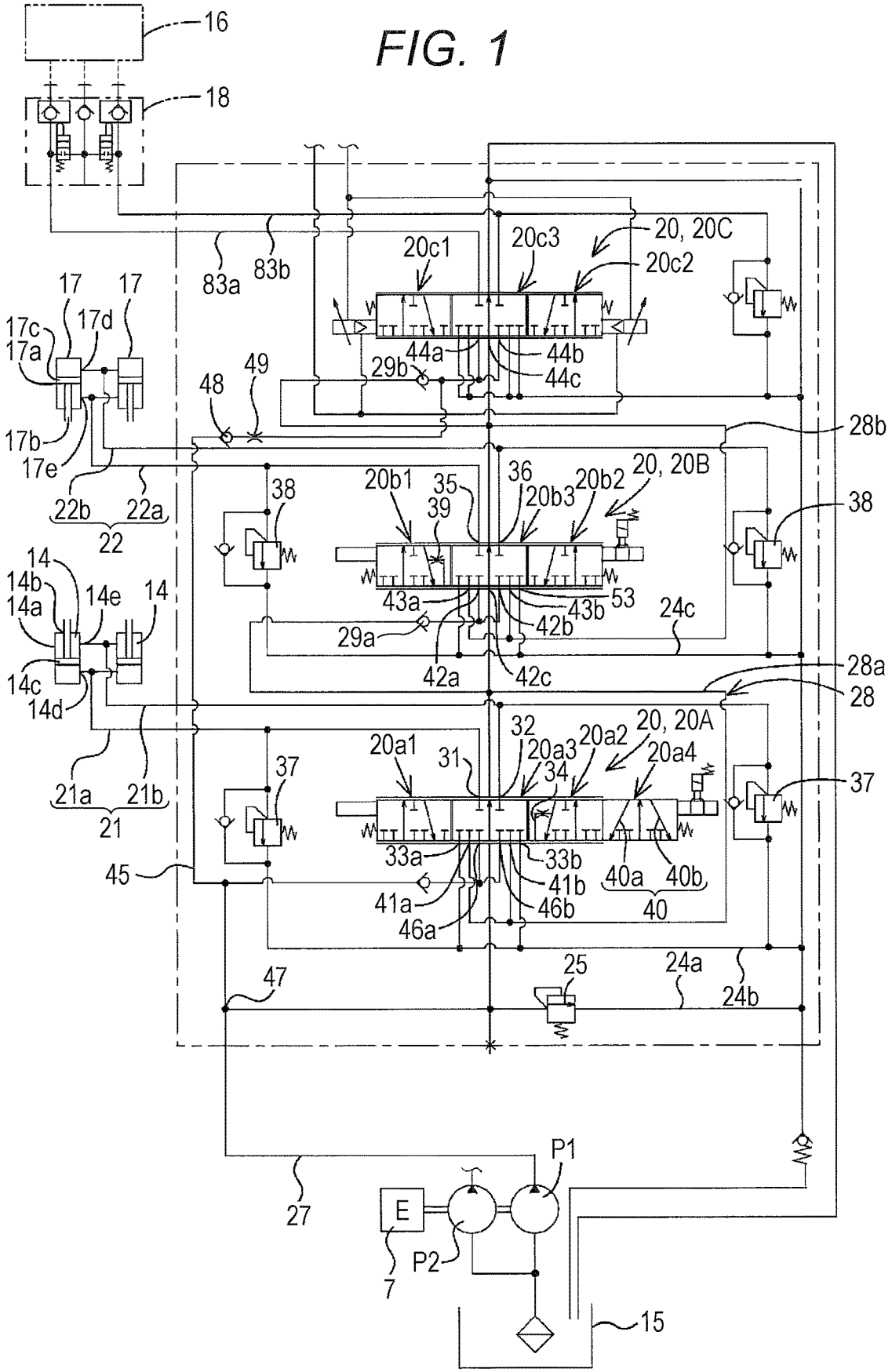
FIG. 1 is a diagram illustrating a hydraulic system (hydraulic circuit) according to a first embodiment.

The embodiments will now be described with reference to the accompanying drawings, wherein like reference numerals designate corresponding or identical elements throughout the various drawings.

Hereinafter, a hydraulic system of a work machine and a work machine including the hydraulic system according to embodiments of the present invention will be described with reference to the drawings.

First Embodiment

First, a work machine is described.

Figure 6:
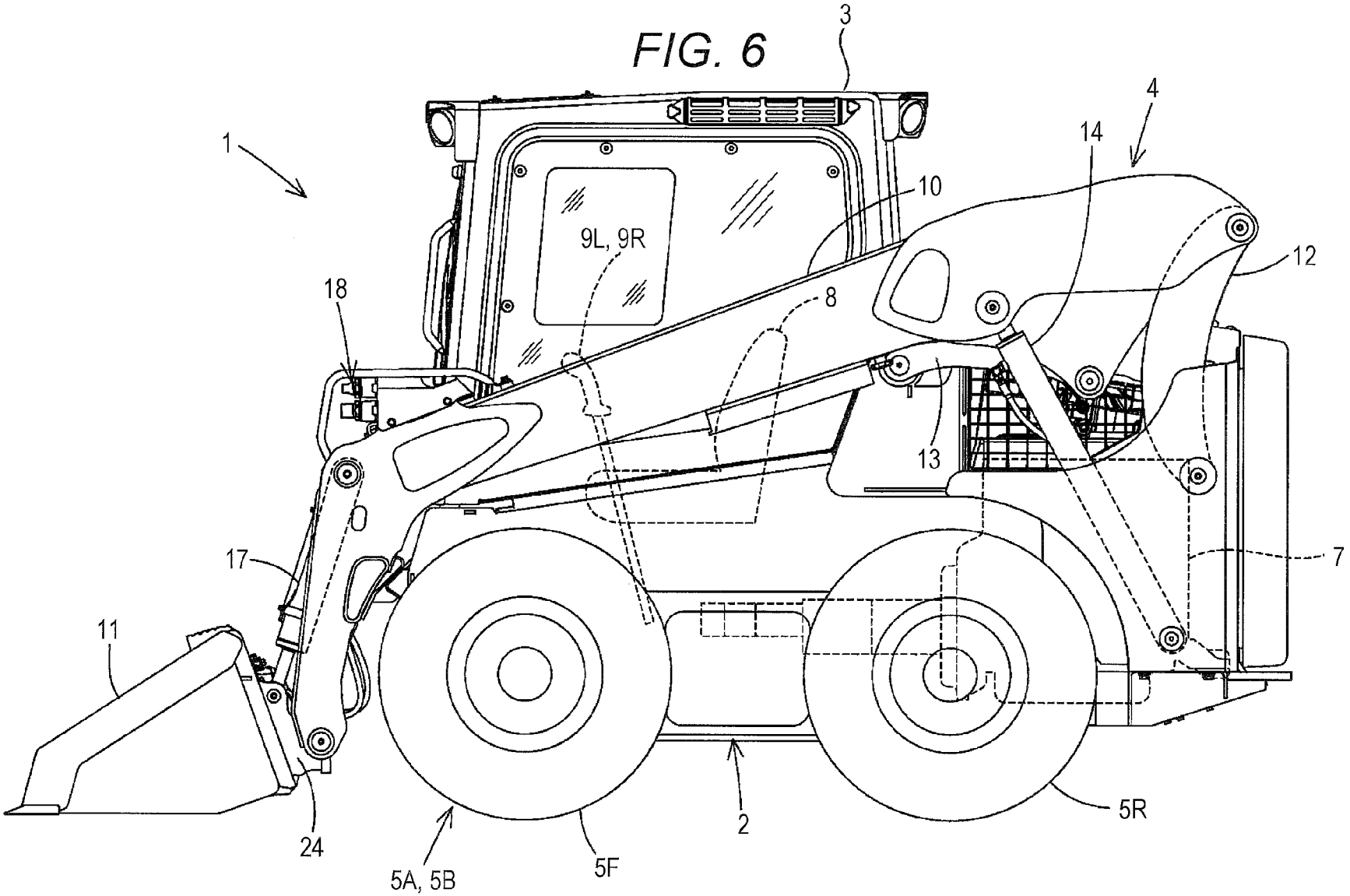
FIG. 6 is an overall view of a skid steer loader illustrated as an example of a work machine.

FIG. 6 is a side view of a work machine according to embodiments of the present invention. In FIG. 6, a skid steer loader is illustrated as an example of a work machine 1. However, the work machine 1 according to embodiments of the present invention is not limited to a skid steer loader and may be, for example, any other types of loader work machines such as a compact track loader. Alternatively, the work machine 1 may be a work machine other than a loader work machine.

The work machine 1 includes a frame (body) 2, a cabin 3, a working device 4, and travelling devices 5A and 5B.

The cabin 3 is mounted on the frame 2. A driver's seat 8 is provided in a rear part of the cabin 3. In the embodiments of the present invention, it is assumed that a front side (left side in FIG. 6) of a driver sitting on a driver's seat 8 of the work machine 1 is a forward direction, a rear side (right side in FIG. 6) of the driver is a backward direction, a left side (near side in FIG. 6) of the driver is a leftward direction, and a right side (far side in FIG. 6) of the driver is a rightward direction. Furthermore, it is assumed that a horizontal direction that is orthogonal to the forward and backward directions is a frame width direction. Furthermore, it is assumed that a rightward or leftward direction from a central part of the frame 2 is a frame outward direction. In other words, the frame outward direction is the frame width direction and is a direction away from the frame 2. Furthermore, it is assumed that a direction opposite to the frame outward direction is a frame inward direction. In other words, the frame inward direction is the frame width direction and is a direction toward the frame 2.

The cabin 3 is mounted on the frame 2. The working device 4 is a device for a work and is attached to the frame 2. The travelling device 5A is a device for travelling of the frame 2 and is provided on the left side of the frame 2. The travelling device 5B is a device for travelling of the frame 2 and is provided on the right side of the frame 2. A prime mover 7 is provided in a rear part of the frame 2. The prime mover 7 is a diesel engine (engine). Note that the prime mover 7 is not limited to an engine and may be an electric motor or the like.

A travelling lever 9L is provided on the left of the driver's seat 8. A travelling lever 9R is provided on the right of the driver's seat 8. The travelling lever 9L on the left is for operating the travelling device 5A on the left, and the travelling lever 9R on the right is for operating the travelling device 5B on the right.

The working device 4 includes a boom 10, a bucket 11, a lift link 12, a control link 13, a boom cylinder 14, and a bucket cylinder 17. The boom 10 is provided on the sides of the frame 2. The bucket 11 is attached to a head (front end) of the boom 10. The lift link 12 and the control link 13 support a base (rear part) of the boom 10. The boom cylinder 14 drives the boom 10 upward or downward.

More specifically, the lift link 12, the control link 13, and the boom cylinder 14 are provided on the sides of the frame 2. An upper part of the lift link 12 is pivotably supported by an upper part of the base of the boom 10. A lower part of the lift link 12 is pivotably supported by a side part of the frame 2 at the rear part. The control link 13 is disposed on a front side of the lift link 12. One end of the control link 13 is pivotably supported by a lower part of the base of the boom 10, and the other end of the control link 13 is pivotably supported by the frame 2.

The boom cylinder 14 is a hydraulic cylinder that lifts and lowers the boom 10. An upper part of the boom cylinder 14 is pivotably supported by a front part of the base of the boom 10. A lower part of the boom cylinder 14 is pivotably supported by a side part of the frame 2 at the rear part. When the boom cylinder 14 is stretched or contracted, the boom 10 is swung up or down by the lift link 12 and the control link 13. The bucket cylinder 17 is a hydraulic cylinder that swings the bucket 11. The bucket cylinder 17 connects a left part of the bucket 11 and a left boom and connects a right part of the bucket 11 and a right boom. A reserve attachment such as a hydraulic crusher, a hydraulic breaker, an angle bloom, an auger, a pallet fork, a sweeper, a mower, or a snow blower is attachable to the head (front part) of the boom 10 instead of the bucket 11.

In the present embodiment, the travelling devices 5A and 5B are wheel-type travelling devices 5A and 5B having front wheels 5F and rear wheels 5R. Note that a crawler-type (including semi-crawler-type) travelling devices 5A and 5B may be employed as the travelling devices 5A and 5B.

Next, a work-system hydraulic circuit (work-system hydraulic system) provided in the work machine 1 is described.

The work-system hydraulic system is a system for actuating the boom 10, the bucket 11, the reserve attachment, and the like and includes a plurality of control valves 20 and a hydraulic pump of the work system (first hydraulic pump) P1, as illustrated in FIG. 1. Furthermore, the work-system hydraulic system includes a second hydraulic pump P2 that is different from the first hydraulic pump P1.

The first hydraulic pump P1 is a pump that works by power of the prime mover 7 and is realized by a fixed displacement gear pump. The first hydraulic pump P1 is capable of ejecting hydraulic oil stored in a tank (hydraulic oil tank) 15. The second hydraulic pump P2 is a pump that works by power of the prime mover 7 and is realized by a fixed displacement gear pump. The second hydraulic pump P2 is capable of ejecting hydraulic oil stored in the tank (hydraulic oil tank) 15. Note that the second hydraulic pump P2 ejects hydraulic oil for a signal and hydraulic oil for control in the hydraulic system. The hydraulic oil for a signal and the hydraulic oil for control are hereinafter referred to as pilot oil.

The plurality of control valves 20 are valves that control various hydraulic actuators provided in the work machine 1. The hydraulic actuators are devices that work by hydraulic oil and examples thereof include a hydraulic cylinder and a hydraulic motor. In the present embodiment, the plurality of control valves 20 are a boom control valve 20A, a bucket control valve 20B, and a reserve control valve 20C.

The boom control valve 20A is a valve that controls a hydraulic actuator (boom cylinder) 14 that actuates the boom 10. The boom control valve 20A is a direct-acting spool type four-position switch-over valve. The boom control valve 20A is switched among a neutral position 20*a*3, a first position 20*a*1 that is different from the neutral position 20*a*3, a second position 20*a*2 that is different from the neutral position 20*a*3 and the first position 20*a*1, and a third position 20*a*4. Switching of the boom control valve 20A among the neutral position 20*a*3, the first position 20*a*1, the second position 20*a*2, and the third position 20*a*4 is performed by moving a spool by an operation of an operating member. Although the boom control valve 20A is switched by directly moving the spool by a manual operation of the operating member, the spool may be moved by a hydraulic operation (a hydraulic operation using a pilot valve, a hydraulic operation using a proportional valve), may be moved by an electric operation (an electric operation using excitation of a solenoid), or may be moved by other methods.

The boom control valve 20A and the first hydraulic pump P1 are connected to each other by an ejection oil passage 27. A discharge oil passage 24*a* that leads to the hydraulic oil tank 15 is connected to a section of the ejection oil passage 27 that is located between the boom control valve 20A and the first hydraulic pump P1. A relief valve (main relief valve) 25 is provided at an intermediate part of the discharge oil passage 24*a*. The hydraulic oil ejected from the first hydraulic pump P1 is supplied to the boom control valve 20A through the ejection oil passage 27. The boom control valve 20A and the boom cylinder 14 are connected to each other by an oil passage 21.

More specifically, the boom cylinder 14 includes a cylindrical body 14*a*, a rod 14*b* that is provided in the cylindrical body 14*a* so as to be movable, and a piston 14*c* that is provided on the rod 14*b*. A first port 14*d* that feeds and discharges hydraulic oil is provided in a base end part (on a side opposite to the rod 14*b* side) of the cylindrical body 14*a*. A second port 14*e* that feeds and discharges hydraulic oil is provided in a head (on the rod 14*b* side) of the cylindrical body 14*a*.

The oil passage 21 has a first connection oil passage 21*a* that connects a first port 31 of the boom control valve 20A and the first port 14*d* of the boom cylinder 14 and a second connection oil passage 21*b* that connects a second port 32 of the boom control valve 20A and the second port 14*e* of the boom cylinder 14.

With this arrangement, by causing the boom control valve 20A to be at the first position 20*a*1, the hydraulic oil can be supplied from the first connection oil passage 21*a* to the first port 14*d* of the boom cylinder 14, and the hydraulic oil can be discharged from the second port 14*e* of the boom cylinder 14 to the second connection oil passage 21*b*. This stretches the boom cylinder 14, thereby lifting the boom 10. By causing the boom control valve 20A to be at the second position 20*a*2, the hydraulic oil can be supplied from the second connection oil passage 21*b* to the second port 14*e* of the boom cylinder 14, and the hydraulic oil can be discharged from the first port 14*d* of the boom cylinder 14 to the first connection oil passage 21*a*. This contracts the boom cylinder 14, thereby lowering the boom 10.

The boom control valve 20A has a float part 40 that causes the boom cylinder 14 to perform a float action. The float part 40 is provided in the spool of the boom control valve 20A. The float part 40 includes a passage 40*a* that allows the first port 31 and a first discharge port 33*a* to communicate with each other and a passage 40*b* that allows the second port 32 and a second discharge port 33*b* to communicate with each other. The first discharge port 33*a* and the second discharge port 33*b* are connected to a discharge oil passage 24*b* that leads to the hydraulic oil tank 15.

With this arrangement, by causing the boom control valve 20A to be at the third position 20*a*4, the first port 31 and the first discharge port 33*a* are communicated with each other, and the second port 32 and the second discharge port 33*b* are communicated with each other. The hydraulic oil in the cylindrical body 14*a* of the boom cylinder 14 is discharged to the discharge oil passage 24*b* through the oil passage 21, the first port 31, the second port 32, the passage 40*a*, the passage 40*b*, the first discharge port 33*a*, and the second discharge port 33*b*. As a result, the boom cylinder 14 performs a float action.

The float action of the boom cylinder 14, i.e., switching of the boom control valve 20A to the third position 20*a*4 can be performed, for example, by a switch provided around the driver's seat 8. When the switch is turned on, the boom control valve 20A is switched to the third position 20*a*4 and thereby the float action can be started.

Note that the first connection oil passage 21*a* and the second connection oil passage 21*b* are connected to the discharge oil passage 24*b*. A relief valve 37 is provided in the discharge oil passage 24*b*.

The bucket control valve 20B is a valve that controls a hydraulic cylinder (bucket cylinder) 17 that controls the bucket 11. The bucket control valve 20B is a pilot-type direct-acting spool three-position switch-over valve. The bucket control valve 20B is switched among a neutral position 20*b*3, a first position 20*b*1 that is different from the neutral position 20*b*3, and a second position 20*b*2 that is different from the neutral position 20*b*3 and the first position 20*b*1. Switching of the bucket control valve 20B among the neutral position 20*b*3, the first position 20*b*1, and the second position 20*b*2 is performed by moving a spool by an operation of an operating member. Although the bucket control valve 20B is switched by directly moving the spool by a manual operation of the operating member, the spool may be moved by a hydraulic operation (a hydraulic operation using a pilot valve, a hydraulic operation using a proportional valve), may be moved by an electric operation (an electric operation using excitation of a solenoid), or may be moved by other methods.

The bucket control valve 20B and the bucket cylinder 17 are connected to each other by an oil passage 22. More specifically, the bucket cylinder 17 includes a cylindrical body 17*a*, a rod 17*b* that is provided in the cylindrical body 17*a* so as to be movable, and a piston 17*c* that is provided on the rod 17*b*. A first port 17*d* that feeds and discharges the hydraulic oil is provided in a base end part (on a side opposite to the rod 17*b*) of the cylindrical body 17*a*. A second port 17*e* that feeds and discharges the hydraulic oil is provided in a head (on the rod 17*b* side) of the cylindrical body 17*a*.

The oil passage 22 has a third connection oil passage 22*a* of the bucket cylinder 17 that connects a first port 35 of the bucket control valve 20B and the second port 17*e*, and a fourth connection oil passage 22*b* that connects a second port 36 of the bucket control valve 20B and the first port 17*d* of the bucket cylinder 17.

With this arrangement, by causing the bucket control valve 20B to be at the first position 20*b*1, the hydraulic oil can be supplied from the third connection oil passage 22*a* to the second port 17*e* of the bucket cylinder 17, and the hydraulic oil can be discharged from the first port 17*d* of the bucket cylinder 17 to the fourth connection oil passage 22*b*. This contracts the bucket cylinder 17, thereby causing the bucket 11 to perform a scooping action. By causing the bucket control valve 20B to be at the second position 20*b*2, the hydraulic oil can be supplied from the fourth connection oil passage 22*b* to the first port 17*d* of the bucket cylinder 17, and the hydraulic oil can be discharged from the second port 17*e* of the bucket cylinder 17 to the third connection oil passage 22*a*. This stretches the bucket cylinder 17, thereby causing the bucket 11 to perform a dumping action.

A discharge oil passage 24*c* is connected to the third connection oil passage 22*a* and the fourth connection oil passage 22*b*, and a relief valve 38 is provided in the discharge oil passage 24*c*. The set pressure of the relief valve 38 is, for example, set higher than that of the main relief valve 25. The set pressure of the relief valve 38 may be set lower than that of the main relief valve 25 so that a hydraulic actuator on an upstream side is more easily actuated.

The reserve control valve 20C is a valve that controls a hydraulic actuator (e.g., a hydraulic cylinder, a hydraulic motor) 16 attached to the reserve attachment. The reserve control valve 20C is a pilot-type direct-acting spool three-position switch-over valve. The reserve control valve 20C is switched among a neutral position 206, a first position 20*c*1 that is different from the neutral position 20*c*3, and a second position 20*c*2 that is different from the neutral position 20*c*3 and the first position 20*c*1. Switching of the reserve control valve 20C among the neutral position 20*c*3, the first position 20*c*1, and the second position 20*c*2 is performed by moving a spool by the pressure of the pilot oil. A connection member 18 is connected to the reserve control valve 20C via feed discharge oil passages 83*a* and 83*b*. An oil passage that is connected to the hydraulic actuator 16 of the reserve attachment is connected to the connection member 18.

With this arrangement, by causing the reserve control valve 20C to be at the first position 20*c*1, the hydraulic oil can be supplied from the feed discharge oil passage 83*a* to the hydraulic actuator 16 of the reserve attachment. By causing the reserve control valve 20C to be at the second position 20*c*2, the hydraulic oil can be supplied from the feed discharge oil passage 83*b* to the hydraulic actuator 16 of the reserve attachment. By thus supplying the hydraulic oil from the feed discharge oil passage 83*a* or the feed discharge oil passage 83*b* to the hydraulic actuator 16, the hydraulic actuator 16 (reserve attachment) can be actuated.

In the hydraulic system, a series circuit (series oil passage) is applied. In the series circuit, hydraulic oil that has returned from a hydraulic actuator to a control valve on an upstream side can be supplied to a control valve on a downstream side. For example, in the case of the boom control valve 20A and the bucket control valve 20B, the boom control valve 20A is a control valve on an upstream side, and the bucket control valve 20B is a control valve on a downstream side. In the case of the boom control valve 20A and the reserve control valve 20C, the boom control valve 20A is a control valve on an upstream side, and the reserve control valve 20C is a control valve on a downstream side. In this case, the hydraulic oil (return oil) that has returned from the boom cylinder 14 to the control valve 20A on the upstream side can be supplied to the control valve 20C on the downstream side.

In the present embodiment and the second embodiment, a control valve on an upstream side is referred to as a "first control valve", and a control valve on a downstream side is referred to as a "second control valve". A control valve between the first control valve and the second control valve is referred to as a "fourth control valve". A hydraulic actuator that corresponds to the first control valve is referred to as a "first hydraulic actuator", a hydraulic actuator that corresponds to the second control valve is referred to as a "second hydraulic actuator", and a hydraulic actuator that corresponds to the fourth control valve is referred to as a "fourth hydraulic actuator". An oil passage on an upstream side among oil passages connected to the first control valve (an oil passage that supplies hydraulic oil to the first control valve) is referred to as a first oil passage.

In the present embodiment, the boom control valve 20A is the "first control valve", the reserve control valve 20C is the "second control valve", and the bucket control valve 20B is the "fourth control valve". The boom cylinder 14 is the "first hydraulic actuator", the hydraulic actuator 16 of the reserve attachment is the "second hydraulic actuator", and the bucket cylinder 17 is the "fourth hydraulic actuator". The first oil passage is the ejection oil passage 27.

Connection and the like of the first control valve, the second control valve, and the fourth control valve are described below.

The first oil passage 27 that is connected to the first control valve 20A connects an ejection part of the first hydraulic pump P1 and a first input port 46*a* and a second input port 46*b* of the first control valve 20A. That is, the hydraulic oil ejected from the first hydraulic pump P1 is supplied to the first control valve 20A through the first oil passage 27.

The first control valve 20A has a discharge oil passage 34 for discharging return oil from the first hydraulic actuator 14. The discharge oil passage 34 is provided in the spool of the first control valve 20A. The discharge oil passage 34 is a passage that allows the first port 31 and the first discharge port 33*a* to communicate with each other. By causing the first control valve 20A to be at the second position 20*a*2, the first port 31 and the first discharge port 33*a* are communicated with each other. This allows part of the return oil from the first hydraulic actuator 14 to be discharged to the hydraulic oil tank 15. That is, in a case where the first hydraulic actuator 14 is contracted, the amount of hydraulic oil that flows toward the fourth control valve 20B and the like is larger than that in a case where the first hydraulic actuator 14 is stretched, because of a relationship between the rod 14*b* and the piston 14*c* in terms of cross sectional area. Since part of the return oil is discharged by the discharge oil passage 34, the amount of hydraulic oil that flows toward the fourth control valve 20B can be made substantially the same as that in a case where the first hydraulic actuator 14 is stretched.

The first control valve 20A and the second control valve 20C (reserve control valve 20C) are connected to each other by a second oil passage 28. The second oil passage 28 is an oil passage that allows return oil that is hydraulic oil returning from the first hydraulic actuator 14 (boom cylinder 14) to the first control valve 20A to be supplied to the second control valve 20C.

The second oil passage 28 includes a first supply passage 28*a* (a first sub oil passage 28*a*) and a second supply passage 28*b* (a second sub oil passage 28*b*). The first supply passage 28*a* is an oil passage that connects the first control valve 20A and the fourth control valve 20B. The second supply passage 28*b* is an oil passage that connects the fourth control valve 20B and the second control valve 20C.

More specifically, the first supply passage 28*a* connects a first output port 41*a* of the first control valve 20A and a first input port 42*a* of the fourth control valve 20B and connects a second output port 41*b* of the first control valve 20A and a second input port 42*b* of the fourth control valve 20B. The first supply passage 28*a* connects the first output port 41*a* and the second output port 41*b* and a third input port 42*c* of the fourth control valve 20B. A check valve 29*a* that allows flow of the hydraulic oil from the first control valve 20A to the fourth control valve 20B and blocks flow of the hydraulic oil from the fourth control valve 20B to the first control valve 20A is provided in the first supply passage 28*a*.

With this arrangement, the return oil that has returned from the first hydraulic actuator 14 to the first port 31 of the first control valve 20A is discharged from the first output port 41*a* and passes through the first supply passage 28*a*. The return oil that has returned from the first hydraulic actuator 14 to the second port 32 of the first control valve 20A is discharged from the second output port 41*b* and passes through the first supply passage 28*a*. Then, the hydraulic oil discharged from the first output port 41*a* or the second output port 41*b* enters the first input port 42*a*, the second input port 42*b*, and the third input port 42*c*. In this way, the return oil that has returned to the first control valve 20A can be supplied to the fourth control valve 20B by the first supply passage 28*a*.

The second supply passage 28*b* connects a first output port 43*a* of the fourth control valve 20B and a first input port 44*a* of the second control valve 20C and connects a second output port 43*b* of the fourth control valve 20B and a second input port 44*b* of the second control valve 20C. The second supply passage 28*b* connects the first output port 43*a* and the second output port 43*b* and a third input port 44*c* of the second control valve 20C. A check valve 29*b* that allows flow of the hydraulic oil from the fourth control valve 20B to the second control valve 20C and blocks flow of the hydraulic oil from the second control valve 20C to the fourth control valve 20B is provided in the second supply passage 28*b*.

The fourth control valve 20B has a discharge oil passage 39 that discharges return oil from the fourth hydraulic actuator 17. The discharge oil passage 39 is provided in the spool of the fourth control valve 20B. The discharge oil passage 39 is a passage that allows the first port 35 and a discharge port 53 to communicate with each other. By causing the fourth control valve 20B to be at the first position 20*a*1, the first port 35 and the discharge port 53 are communicated with each other. The discharge port 53 is connected to the discharge oil passage 24*c*. Therefore, part of the return oil from the fourth hydraulic actuator 17 can be discharged to the hydraulic oil tank 15.

With this arrangement, the return oil that has returned from the fourth hydraulic actuator 17 to the first port 35 of the fourth control valve 20B is discharged from the first output port 43*a* and passes through the second supply passage 28*b*. The return oil that has returned from the fourth hydraulic actuator 17 to the second port 36 of the fourth control valve 20B is discharged from the second output port 43*b* and passes through the second supply passage 28*b*. Then, the hydraulic oil discharged from the first output port 43*a* or the second output port 43*b* enters the first input port 44*a*, the second input port 44*b*, and the third input port 44*c*. In this way, the return oil that has returned to the fourth control valve 20B can be supplied to the second control valve 20C by the second supply passage 28*b*. Furthermore, the hydraulic oil discharged from the first control valve 20A can be supplied to the second control valve 20C by the first supply passage 28*a* and the second supply passage 28*b*.

A bypass oil passage 45 that connects the first oil passage 27 and the second oil passage 28 is connected as illustrated in FIG. 1. More specifically, one end of the bypass oil passage 45 is connected to a section of the first oil passage 27 that is located between a connection part 47 to which the discharge oil passage 24*a* is connected and the first input port 46*a* and the second input port 46*b*. Furthermore, the other end of the bypass oil passage 45 is connected to a section of the second supply passage 28*b* that is located between the check valve 29*b* and the first output port 43*a* and the second output port 43*b*.

A check valve 48 is provided at an intermediate part of the bypass oil passage 45. The check valve 48 allows flow of the hydraulic oil from the first oil passage 27 side to the second oil passage 28 (second supply passage 28*b*) side and blocks flow of the hydraulic oil from the second oil passage 28 (second supply passage 28*b*) side to the first oil passage 27 side. A restricting part 49 (a throttle 49) that reduces a flow amount of the hydraulic oil in the bypass oil passage 45 is provided at an intermediate part of the bypass oil passage 45. Specifically, the restricting part 49 is provided at a part of the bypass oil passage 45 on a downstream side (second control valve 20C side) of the check valve 48.

With this arrangement, the bypass oil passage 45 allows the hydraulic oil that has not been introduced into the first control valve 20A (the hydraulic oil ejected from the first hydraulic pump P1) to be supplied to the second control valve 20C without passing through the first control valve 20A and the first hydraulic actuator 14. That is, the hydraulic oil can be supplied to the second control valve 20C without passing through the series circuit between the first control valve 20A and the second control valve 20C.

In a conventional series circuit, it is difficult to actuate the second control valve 20C (second hydraulic actuator 17), for example, in a case where the relief valve (main relief valve) 25 performs a relieving action. In other words, it is conventionally difficult to actuate the second control valve 20C (second hydraulic actuator 17) in a case where load pressure applied to a hydraulic actuator exceeds the set pressure of the relief valve 25 during simultaneous operations of the plurality of control valves 20. In an embodiment of the present invention, the bypass oil passage 45 allows the hydraulic oil to be supplied to the second control valve 20C, thereby making it possible to actuate the second hydraulic actuator 17. Furthermore, even in a case where the return oil introduced into the first control valve 20A or the fourth control valve 20B cannot be supplied to a downstream side for some reason, the hydraulic oil can be supplied to the second control valve 20C and thereby the second hydraulic actuator 17 can be actuated. That is, a plurality of control valves (hydraulic actuators) can be easily actuated in a series circuit.

Second Embodiment

Figure 2:
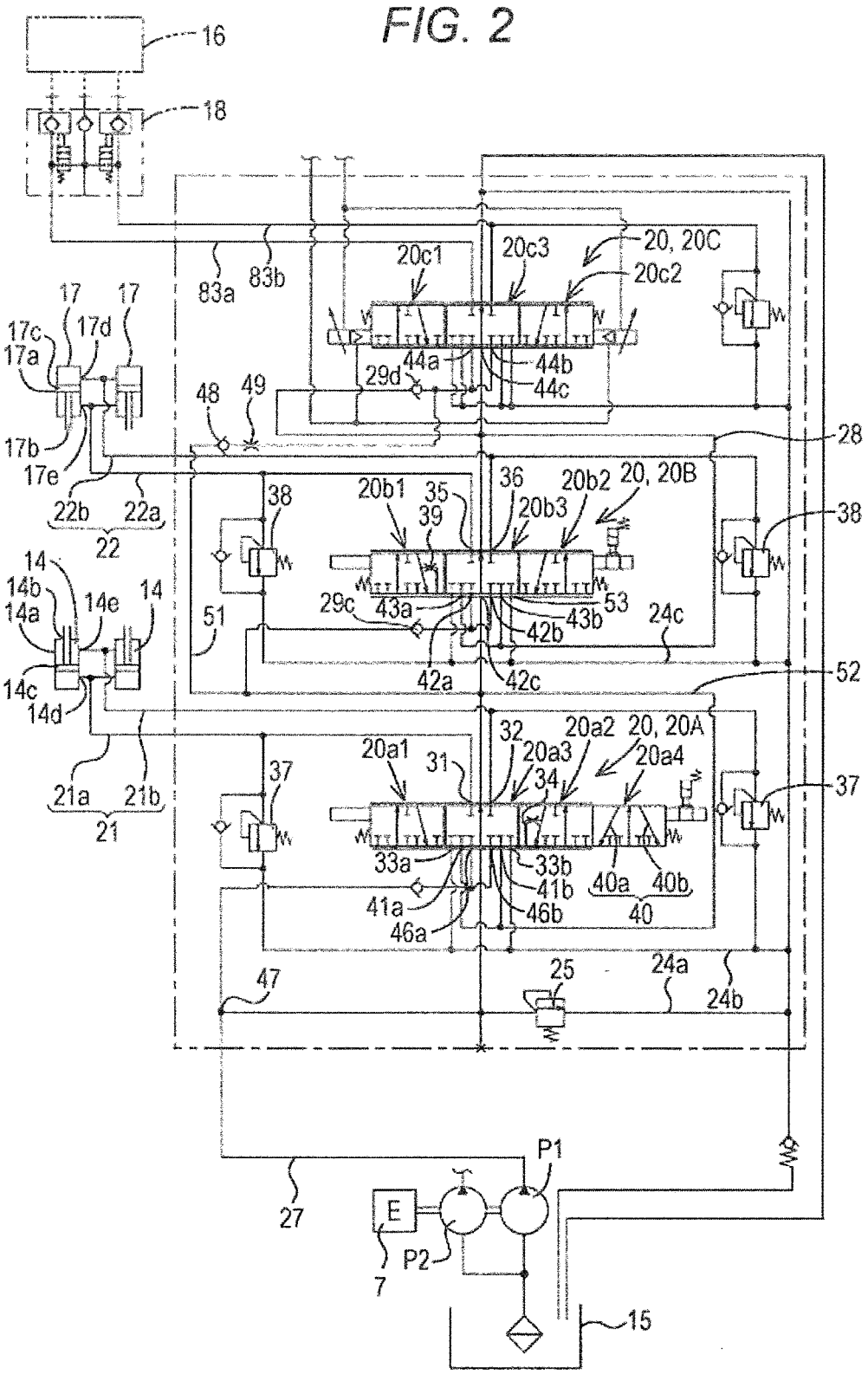
FIG. 2 is a diagram illustrating a hydraulic system (hydraulic circuit) according to a second embodiment.

FIG. 2 illustrates a hydraulic system according to a second embodiment. In the second embodiment, a bucket control valve 20B is a "first control valve", and a reserve control valve 20C is a "second control valve". As illustrated in FIG. 2, the first control valve 20B and the second control valve 20C are connected to each other by a bypass oil passage 51. In the present embodiment, a bucket cylinder 17 is a "first hydraulic actuator", and a hydraulic actuator 16 of a reserve attachment is a "second hydraulic actuator". A control valve on an upstream side of the first control valve is hereinafter referred to as a "third control valve". That is, a boom control valve 20A is the "third control valve". A hydraulic actuator that corresponds to the third control valve is hereinafter referred to as a "third hydraulic actuator". That is, a boom cylinder 14 is the "third hydraulic actuator".

As illustrated in FIG. 2, a first oil passage 52 that supplies hydraulic oil to the first control valve 20B is an oil passage that allows return oil that is hydraulic oil returning from the third hydraulic actuator 14 to the third control valve 20A to be supplied to the first control valve 20B.

The first oil passage 52 connects a first output port 41*a* of the third control valve 20A and a first input port 42*a* of the first control valve 20B and connects a second output port 41*b* of the third control valve 20A and a second input port 42*b* of the first control valve 20B. Furthermore, the first oil passage 52 connects the first output port 41*a* and the second output port 41*b* and a third input port 42*c* of the first control valve 20B. A check valve 29*c* that allows flow of the hydraulic oil from the third control valve 20A to the first control valve 20B and blocks flow of the hydraulic oil from the first control valve 20B to the third control valve 20A is provided in the first oil passage 52.

A second oil passage 28 connects a first output port 43*a* of the first control valve 20B and a first input port 44*a* of the second control valve 20C and connects a second output port 43*b* of the first control valve 20B and a second input port 44*b* of the second control valve 20C. Furthermore, the second oil passage 28 connects the first output port 43*a* and the second output port 43*b* and a third input port 44*c* of the first control valve 20B. A check valve 29*d* that allows flow of the hydraulic oil from the first control valve 20B to the second control valve 20C and block flow of the hydraulic oil from the second control valve 20C to the first control valve 20B is provided in the second oil passage 28.

The bypass oil passage 51 connects the first oil passage 52 and the second oil passage 28. More specifically, one end of the bypass oil passage 51 is connected to a part of the first oil passage 52 on a downstream side of the check valve 29*c*. The other end of the bypass oil passage 51 is connected to a section of the second oil passage 28 that is located between the check valve 29*d* and the first input port 44*a* and the second input port 44*b*. A check valve 48 and a restricting part 49 are provided in the bypass oil passage 51.

With this arrangement, the bypass oil passage 51 allows hydraulic oil that has not been introduced into the first control valve 20B (hydraulic oil that is output from the third control valve 20A) to be supplied to the second control valve 20C without passing through the first control valve 20B and the first hydraulic actuator 17. That is, the hydraulic oil can be supplied to the second control valve 20C without passing through a series circuit between the first control valve 20B and the second control valve 20C. Even in a case where the return oil that is output from the first control valve 20B cannot be supplied to a downstream side for some reason, the hydraulic oil can be supplied to the second control valve 20C, and thereby the hydraulic actuator 16 can be actuated.

Third Embodiment

Figure 3:
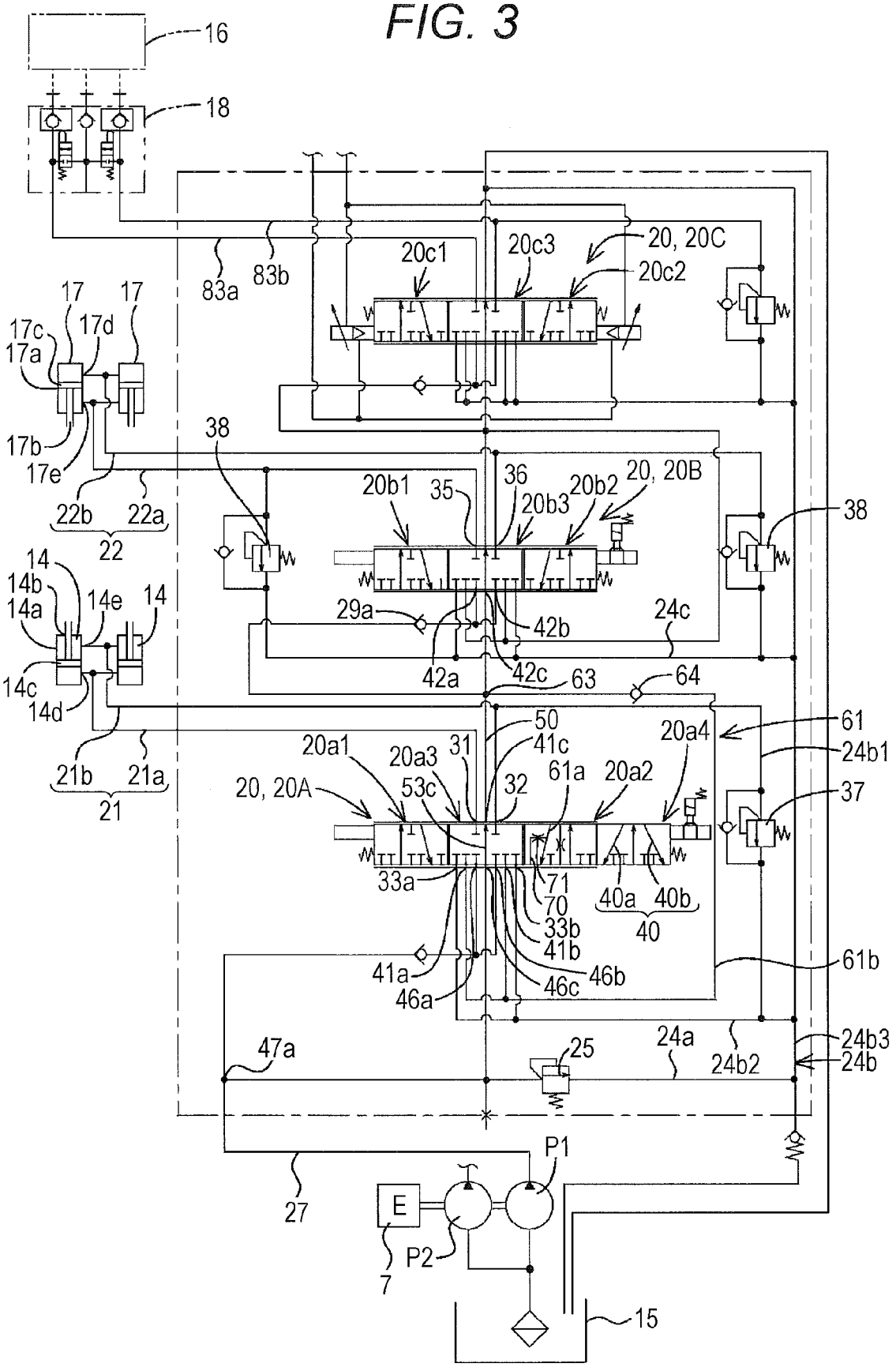
FIG. 3 is a diagram illustrating a hydraulic system (hydraulic circuit) according to a third embodiment.

FIG. 3 illustrates a hydraulic system according to a third embodiment. In FIG. 3, elements that are identical to those in the first embodiment are given identical reference signs, and detailed description thereof is omitted. Also in the third embodiment, a series circuit (series oil passage) is applied in the hydraulic system. In the series circuit, hydraulic oil that has returned from a hydraulic actuator to a control valve on an upstream side can be supplied to a control valve on a downstream side. For example, in the case of the boom control valve 20A and the bucket control valve 20B, the boom control valve 20A is a control valve on an upstream side, and the bucket control valve 20B is a control valve on a downstream side.

In the present embodiment and a fourth embodiment, a control valve on an upstream side is referred to as a "first control valve", and a control valve on a downstream side is referred to as a "second control valve". A hydraulic actuator that corresponds to the first control valve is referred to as a "first hydraulic actuator", and a hydraulic actuator that corresponds to the second control valve is referred to as a "second hydraulic actuator". An oil passage that allows return oil that is hydraulic oil returning from the first hydraulic actuator to the first control valve to be supplied to the second control valve is referred to as a "second oil passage".

In the present embodiment, the boom control valve 20A is the "first control valve", and the bucket control valve 20B is the "second control valve". A boom cylinder 14 is the "first hydraulic actuator", and a bucket cylinder 17 is the "second hydraulic actuator".

The first control valve and the second control valve are described below in detail.

The first control valve 20A and an ejection part of a first hydraulic pump P1 are connected to each other by an ejection oil passage (first oil passage) 27. The ejection oil passage 27 branches at an intermediate part 47*a*. An oil passage branched from the ejection oil passage 27 is connected to a first input port 46*a* and a second input port 46*b* of the first control valve 20A. Furthermore, the ejection oil passage 27 is connected to a third input port 46*c* of the first control valve 20A. With this arrangement, the hydraulic oil ejected from the first hydraulic pump P1 can be supplied to the first control valve 20A through the ejection oil passage 27, the first input port 46*a*, the second input port 46*b*, and the third input port 46*c*.

The first control valve 20A and the second control valve 20B are connected to each other by a central oil passage (third oil passage) 50. The central oil passage 50 connects a third output port 41*c* of the first control valve 20A and a third input port 42*c* of the second control valve 20B.

In a case where the first control valve 20A is at a neutral position 20*a*3, supply oil that is hydraulic oil supplied from the ejection oil passage 27 to the first control valve 20A is supplied to the central oil passage 50 through the first control valve 20A because the third input port 46*c* and the third output port 41*c* are communicated with each other by a central oil passage 53*c*. In a case where the first control valve 20A is at a second position 20*a*2, the central oil passage 53*c* is not completely blocked, and part of the hydraulic oil introduced into the third input port 46*c* flows from the third output port 41*c* to the central oil passage 50 through the central oil passage 53*c*. That is, the first control valve 20A can be switched between the neutral position 20*a*3 at which supply oil supplied from the ejection oil passage 27 to the first control valve 20A is supplied to the central oil passage 50 and the second position 20*a*2 that is a side position at which the supply oil is supplied to the first hydraulic actuator 14 and the central oil passage 50 and flows to the second control valve 20B. In other words, the first control valve 20A is a valve arranged such that an oil passage (central oil passage 53*c*) corresponding to the neutral position 20*a*3 is not fully closed in a case where the first control valve 20A is at the second position 20*a*2. In the above example, the central oil passage 53*c* is not completely blocked in a case where the first control valve 20A is at the second position 20*a*2. However, the first control valve 20A may be arranged such that the oil passage (central oil passage 53*c*) corresponding to the neutral position 20*a*3 is not fully closed in a case where the first control valve 20A is at a first position 20*a*1 that is a side position. Alternatively, the first control valve 20A may be arranged such that the oil passage (central oil passage 53*c*) corresponding to the neutral position 20*a*3 is not fully closed in a case where the first control valve 20A is at the first position 20*a*1 or the second position 20*a*2.

The first control valve 20A and the second control valve 20B are connected to each other not only by the central oil passage 50, but also by a second oil passage 61. The second oil passage 61 is an oil passage that allows return oil returning from the first hydraulic actuator 14 to the first control valve 20A to be supplied to the second control valve 20B through the first control valve 20A.

The second oil passage 61 has an oil passage (first connection oil passage) 21*a*, an inner oil passage 61*a*, and an outer oil passage 61*b*. The first connection oil passage 21*a* is an oil passage that connects a first port 31 of the first control valve 20A and a first port 14*d* of the first hydraulic actuator 14 and is a first return oil passage through which the return oil discharged from the first port 14*d* of the first hydraulic actuator 14 flows.

A second connection oil passage (oil passage) 21*b* that is different from the first connection oil passage 21*a* is an oil passage that connects a second port 32 of the first control valve 20A and a second port 14*e* of the first hydraulic actuator 14 and is a second return oil passage through which return oil discharged from the second port 14*e* flows. The second connection oil passage 21*b* is connected to a discharge oil passage 24*b*. The discharge oil passage 24*b* has an oil passage (fourth oil passage) 24*b*1 that is connected to the second connection oil passage 21*b*, an oil passage 24*b*2 that is connected to a first discharge port 33*a* and a second discharge port 33*b* of the first control valve 20A, and an oil passage 24*b*3 that connects a part at which the oil passage 24*b*1 and the oil passage 24*b*2 merge and the hydraulic oil tank 15. A relief valve 37 is provided at an intermediate part of the oil passage 24*b*1 (fourth oil passage). The set pressure of the relief valve 37 is, for example, set higher than that of a main relief valve 25. Note that the set pressure of the relief valve 37 may be set lower than that of the main relief valve 25 so that the first hydraulic actuator 14 is more easily actuated.

The inner oil passage 61*a* is an oil passage that is provided in the first control valve 20A and is communicated with the first connection oil passage 21*a*. More specifically, the inner oil passage 61*a* is an oil passage that connects the first port 31 of the first control valve 20A and a first output port 41*a* of the first control valve 20A in a case where the first control valve 20A is at the second position 20*a*2.

The outer oil passage 61*b* is an oil passage that is communicated with the inner oil passage 61*a* and is connected to the second control valve 20B. The outer oil passage 61*b* connects the first output port 41*a* of the first control valve 20A and a first input port 42*a* of the second control valve 20B and connects a second output port 41*b* of the first control valve 20A and a second input port 42*b* of the second control valve 20B. An intermediate part of the outer oil passage 61*b* is connected to the central oil passage 53*c*. In other words, the outer oil passage 61*b* and the central oil passage 53*c* merge with each other at intermediate parts thereof. A check valve 29*a* is provided at a part of the outer oil passage 61*b* that is located between a merging part 63 at which the outer oil passage 61*b* and the central oil passage 53*c* merge and the second control valve 20B. The check valve 29*a* allows flow of the hydraulic oil from the merging part 63 to the second control valve 20B and blocks flow of the hydraulic oil from the second control valve 20B to the merging part 63.

A first check valve 64 is provided at a part of the outer oil passage 61*b* that is located between the merging part 63 and the first control valve 20A. The first check valve 64 allows flow of the hydraulic oil from the first control valve 20A to the merging part 63 and blocks flow of the hydraulic oil from the merging part 63 to the first control valve 20A.

The work system hydraulic system includes a discharge oil passage 70 that is branched from the second oil passage 61 and that discharges return oil. Specifically, the discharge oil passage 70 is an oil passage that is branched from the inner oil passage 61*a* and is communicated with the first discharge port 33*a* in a case where the first control valve 20A is at the second position 20*a*2. A restricting part 71 that reduces a flow amount of the hydraulic oil is provided in the drain oil passage 70. The restricting part 71 is realized, for example, by making a part of the drain oil passage 70 thinner than the other part. In other words, the restricting part 71 is realized by making a cross sectional area of a part of the drain oil passage 70 through which the hydraulic oil flows smaller than that of the other part. The configuration of the restricting part 71 is not limited to the above example.

With this arrangement, by causing the first control valve 20A to be at the second position 20*a*2, the first port 31 and the first discharge port 33*a* are communicated with each other. This allows part of the return oil from the first hydraulic actuator 14 to be discharged to the hydraulic oil tank 15. That is, in a case where the first hydraulic actuator 14 is contracted, the amount of hydraulic oil that flows toward the second control valve 20B and the like is larger than that in a case where the first hydraulic actuator 14 is stretched, because of a relationship between a rod 14*b* and a piston 14*c* in terms of cross sectional areas. Since part of the return oil is discharged by the drain oil passage 70, the amount of hydraulic oil flowing toward the second control valve 20B can be made substantially the same as that in a case where the first hydraulic actuator 14 is stretched.

The return oil that has returned from the first hydraulic actuator 14 to the first port 31 of the first control valve 20A is discharged from the first output port 41*a* through the inner oil passage 61*a*. The hydraulic oil discharged from the first output port 41*a* can be supplied to the second control valve 20B through the outer oil passage 61*b*. Since the first check valve 64 is provided at a part of the outer oil passage 61*b* that is located between the merging part 63 and the first control valve 20A, it is possible to prevent the hydraulic oil in the outer oil passage 61*b* from returning to the first control valve 20A because of a relationship between the pressure of the hydraulic oil in the central oil passage 53*c* and the pressure of the hydraulic oil flowing from the outer oil passage 61*b* toward the second control valve 20B.

Fourth Embodiment

Figure 4:
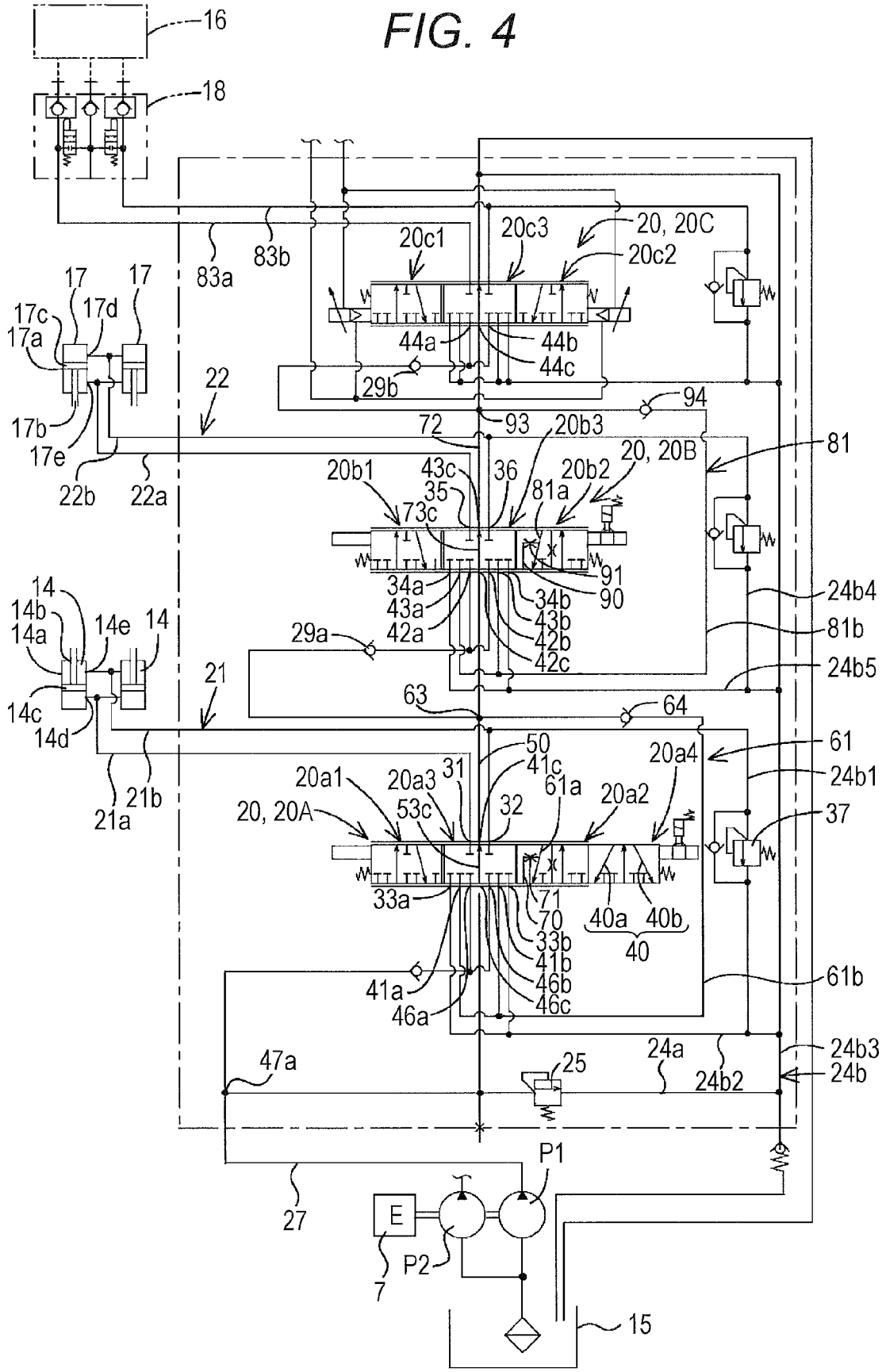
FIG. 4 is a diagram illustrating a hydraulic system (hydraulic circuit) according to a fourth embodiment.

FIG. 4 illustrates a hydraulic system (hydraulic circuit) of a work machine according to a fourth embodiment. Parts that are similar to those in Third Embodiment are given similar reference signs and description thereof is omitted. For convenience of description, in the fourth embodiment, a bucket control valve 20B is a "first control valve", and a reserve control valve 20C is a "second control valve". Furthermore, a bucket cylinder 17 is a "first hydraulic actuator", and a hydraulic actuator 16 is a "second hydraulic actuator".

The first control valve 20B and the second control valve 20C are connected to each other by a central oil passage (third oil passage) 72. The central oil passage 72 connects a third output port 43*c* of the first control valve 20B and a third input port 44*c* of the second control valve 20C.

In a case where the first control valve 20B is at a neutral position 20*b*3, supply oil that is hydraulic oil supplied to the first control valve 20B is supplied to the central oil passage 72 through the first control valve 20B because a third input port 42*c* and the third output port 43*c* are communicated with each other by a central oil passage 73*c*. In a case where the first control valve 20B is at a second position 20*b*2, the central oil passage 73*c* is not completely blocked, and part of the hydraulic oil introduced into the third input port 42*c* flows from the third output port 43*c* to the central oil passage 72 through the central oil passage 73*c*. That is, the first control valve 20B can be switched between the neutral position 20*b*3 at which supply oil supplied to the first control valve 20B is supplied to the central oil passage 72 and the second position 20*b*2 that is a side position at which the supply oil is supplied to the first hydraulic actuator 17 and the central oil passage 72 and flows to the second control valve 20C. In other words, the first control valve 20B is a valve arranged such that an oil passage (central oil passage 73*c*) corresponding to the neutral position 20*b*3 is not fully closed in a case where the first control valve 20B is at the second position 20*b*2. In the above example, the central oil passage 73*c* is not completely blocked in a case where the first control valve 20B is at the second position 20*b*2. However, the first control valve 20B may be arranged such that the oil passage (central oil passage 73*c*) corresponding to the neutral position 20*b*3 is not fully closed in a case where the first control valve 20B is at a first position 20*b*1 that is a side position. Alternatively, the first control valve 20B may be arranged such that the oil passage (central oil passage 73*c*) corresponding to the neutral position 20*b*3 is not fully closed in a case where the first control valve 20B is at the first position 20*b*1 or the second position 20*b*2.

The first control valve 20B and the second control valve 20C are connected to each other not only by the central oil passage 72, but also by a second oil passage 81. The second oil passage 81 is an oil passage that allows return oil returning from the first hydraulic actuator 17 to the first control valve 20B to be supplied to the second control valve 20C through the first control valve 20B.

The second oil passage 81 has an oil passage (third connection oil passage) 22*a*, an inner oil passage 81*a*, and an outer oil passage 81*b*. The third connection oil passage 22*a* is an oil passage that connects a first port 35 of the first control valve 20B and a second port 17*e* of the first hydraulic actuator 17 and is a first return oil passage through which return oil discharged from the second port 17*e* flows.

A fourth connection oil passage (oil passage) 22*b* that is different from the third connection oil passage 22*a* is an oil passage that connects a second port 36 of the first control valve 20B and a first port 17*d* of the first hydraulic actuator 17 and is a second return oil passage through which return oil discharged from the first port 17*d* flows. The fourth connection oil passage 22*b* is connected to a discharge oil passage 24*b*. The discharge oil passage 24*b* has an oil passage (fourth oil passage) 24*b*4 that is connected to the fourth connection oil passage 22*b*, an oil passage 24*b*5 that is connected to a first discharge port 34*a* and a second discharge port 34*b* of the first control valve 20B, and an oil passage 24*b*3 that connects a part at which the oil passage 24*b*4 and the oil passage 24*b*5 merge and a hydraulic oil tank 15.

The inner oil passage 81*a* is an oil passage that is provided in the first control valve 20B and is communicated with the third connection oil passage 22*a*. More specifically, the inner oil passage 81*a* is an oil passage that connects the first port 35 of the first control valve 20B and a first output port 43*a* of the first control valve 20B in a case where the first control valve 20B is at the second position 20*b*2.

The outer oil passage 81*b* is an oil passage that is communicated with the inner oil passage 81*a* and is connected to the second control valve 20C. The outer oil passage 81*b* connects the first output port 43*a* of the first control valve 20B and a first input port 44*a* of the second control valve 20C and connects a second output port 43*b* of the first control valve 20B and a second input port 44*b* of the second control valve 20C. An intermediate part of the outer oil passage 81*b* is connected to the central oil passage 73*c*. In other words, the outer oil passage 81*b* and the central oil passage 73*c* merge with each other at intermediate parts thereof. A check valve 29*b* is provided at a part of the outer oil passage 81*b* that is located between a merging part 93 at which the outer oil passage 81*b* and the central oil passage 73*c* merge and the second control valve 20C. The check valve 29*b* allows flow of the hydraulic oil from the merging part 93 to the second control valve 20C and blocks flow of the hydraulic oil from the second control valve 20C to the merging part 93.

A first check valve 94 is provided at a part of the outer oil passage 81*b* that is located between the merging part 93 and the first control valve 20B. The first check valve 94 allows flow of the hydraulic oil from the first control valve 20B to the merging part 93 and blocks flow of the hydraulic oil from the merging part 93 to the first control valve 20B.

A discharge oil passage 90 that is branched from the second oil passage 81 and that discharges return oil is provided. Specifically, the discharge oil passage 90 is an oil passage that is branched from the inner oil passage 81*a* and is communicated with the first discharge port 34*a* in a case where the first control valve 20B is at the second position 20*b*2. A restricting part 91 that reduces a flow amount of the hydraulic oil is provided in the discharge oil passage 90. The restricting part 91 is realized, for example, by making a part of the discharge oil passage 90 thinner than the other part. In other words, the restricting part 91 is realized by making a cross sectional area of a part of the discharge oil passage 90 through which the hydraulic oil flows smaller than that of the other part. The configuration of the restricting part 91 is not limited to the above example.

With this arrangement, by causing the first control valve 20B to be at the second position 20*b*2, the first port 35 and the first discharge port 34*a* are communicated with each other. This allows part of the return oil from the first hydraulic actuator 17 to be discharged to the hydraulic oil tank 15.

The return oil that has returned from the first hydraulic actuator 17 to the first port 35 of the first control valve 20B is discharged from the first output port 43*a* through the inner oil passage 81*a*. The hydraulic oil discharged from the first output port 43*a* can be supplied to the second control valve 20C through the outer oil passage 81*b*. Since the first check valve 94 is provided at a part of the outer oil passage 81*b* that is located between the merging part 93 and the first control valve 20B, it is possible to prevent the hydraulic oil in the outer oil passage 81*b* from returning to the first control valve 20B because of a relationship between the pressure of the hydraulic oil in the central oil passage 73*c* and the pressure of the hydraulic oil flowing from the outer oil passage 81*b* toward the second control valve 20C.

The embodiments disclosed herein are given only for illustration and should not be construed as being restrictive. The scope of the present invention is indicated not by the above description but by the claims, and it is intended that meanings equivalent to the scope of the claims and all changes within the scope are encompassed within the present invention. In the above embodiments, a bypass oil passage is provided between an upstream side of the boom control valve 20A and a downstream side of the reserve control valve 20C, or a bypass oil passage is provided between an upstream side of the bucket control valve 20B and a downstream side of the reserve control valve 20C. However, the present invention is not limited to these combinations, and all combinations can be applied. In the above embodiments, an example in which three control valves are provided has been described. However, the number of control valves and the number of bypass oil passages are not limited.

The first control valve and the second control valve are not limited to the ones in the above embodiments and can be any control valves provided in a work machine. As a matter of course, the second oil passages 61 and 81, the discharge oil passages 70 and 90, the first check valves 64 and 94, and the restricting parts 71 and 91 are not limited to the ones in the above embodiments, either.

Figure 5:
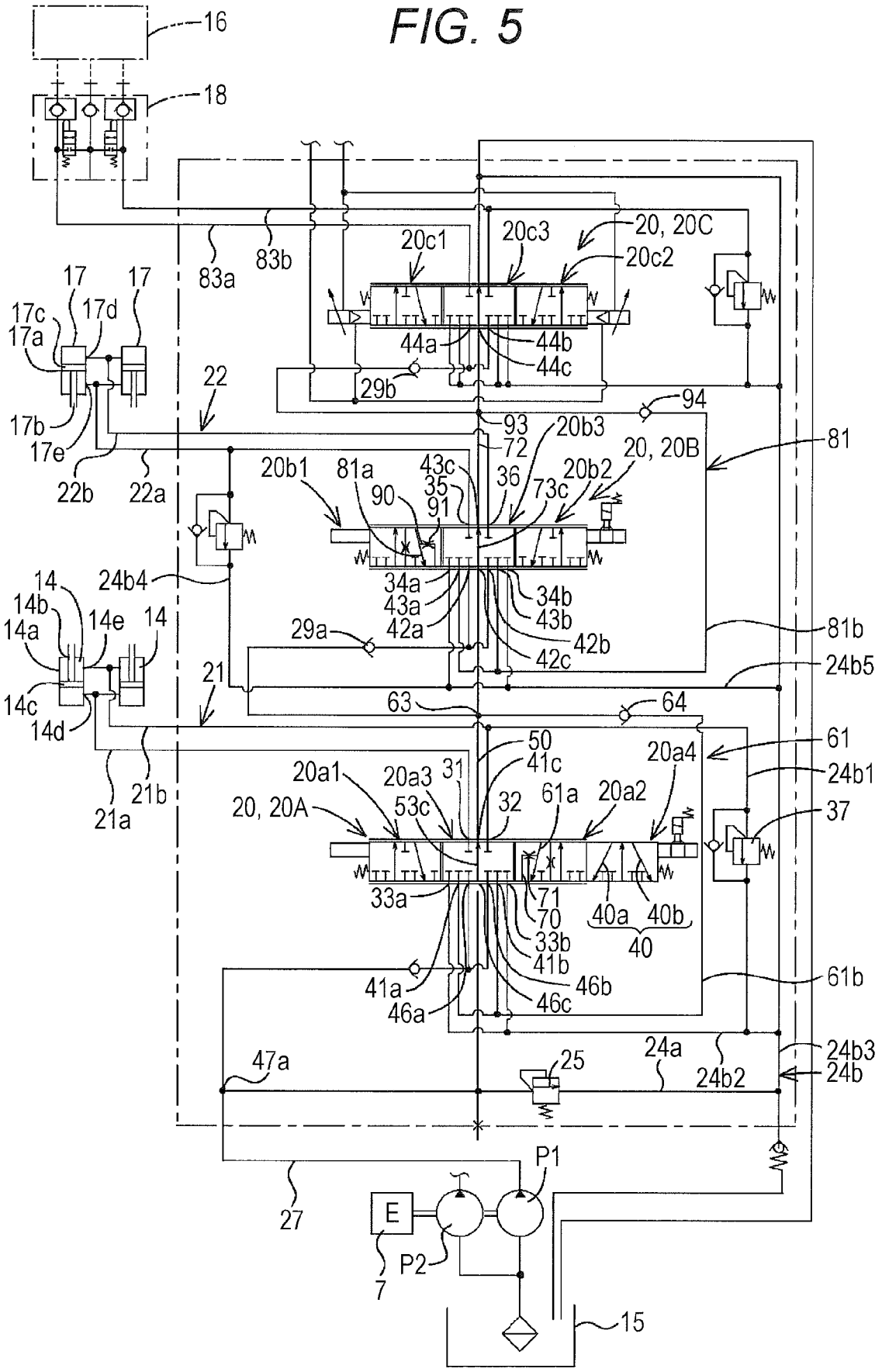
FIG. 5 is a diagram illustrating a modification of a hydraulic system (hydraulic circuit) in which an inner oil passage and the like are modified.

In the above embodiments, the first control valve and the second control valve are arranged such that a central oil passage is not fully closed in a case where the first control valve and the second control valve are at at least one of a first position and a second position. Alternatively, the first control valve and the second control valve may be arranged such that a central oil passage is fully closed in a case where the first control valve and the second control valve are at a first position and at a second position. For example, in the second embodiment, a valve in which a central oil passage is fully closed may be employed as the first control valve, and a valve in which a central oil passage is not fully closed may be employed as the second control valve. The second oil passages 70 and 90 may be provided at parts of the first control valve and the second control valve that correspond to a first position instead of a second position. That is, it is preferable that the second oil passages 70 and 90 be provided at parts of the first control valve and the second control valve on a side where hydraulic oil returns (on a side return oil enters a port) when a hydraulic cylinder contracts. For example, in a case where the boom control valve 20A is regarded as a first control valve and the bucket control valve 20B is regarded as a second control valve in the hydraulic system illustrated in FIG. 5, it is desirable that the second oil passage 70 be provided at a part of the first control valve 20A that corresponds to a second position and that the second oil passage 90 be provided at a part of the second control valve 20B that corresponds to a first position.

In the above example, the central oil passage 73*c* is not completely blocked in a case where the first control valve 20B is at the second position 20*b*2. However, the first control valve 20B may be arranged such that the oil passage (central oil passage 73*c*) corresponding to the neutral position 20*b*3 is not fully closed in a case where the first control valve 20B is at a first position 20*b*1 that is a side position. Alternatively, the first control valve 20B may be arranged such that the oil passage (central oil passage 73*c*) corresponding to the neutral position 20*b*3 is not fully closed in a case where the first control valve 20B is at the first position 20*b*1 or the second position 20*b*2.

In the above embodiments, hydraulic oil is discharged to a hydraulic oil tank. However, hydraulic oil may be discharged to a different place. That is, an oil passage for discharging hydraulic oil may be connected to a place other than a hydraulic oil tank. For example, an oil passage for discharging hydraulic oil may be connected to a sucking part of a hydraulic pump (part that sucks in hydraulic oil) or may be connected to a different part.

In the above embodiment, control valves are three-position switch-over valves or four-position switch-over valves. However, the number of positions among which the control valves are switched is not limited, and the control valves can be two-position switch-over valves or other switching valves. In the above embodiment, the boom control valve 20A is a valve for a float action. However, the boom control valve 20A may be a valve that is not for a float action.

In the above embodiments, a hydraulic pump is a fixed displacement pump. However, a hydraulic pump may be, for example, a variable displacement pump whose ejection amount is changed by changing a swash plate or may be other hydraulic pumps.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic system of a work machine, comprising:

a first hydraulic actuator;

a first control valve connected to the first hydraulic actuator to control the first hydraulic actuator;

a first oil passage connected to the first control valve to supply hydraulic oil to the first control valve;

a second hydraulic actuator;

a second control valve connected to the second hydraulic actuator to control the second hydraulic actuator;

a second oil passage which connects the second control valve and the first hydraulic actuator via the first control valve and through which hydraulic oil returning from the first hydraulic actuator to the first control valve is to be supplied to the second control valve;

a bypass oil passage connecting the first oil passage and the second oil passage; and a check valve provided in the bypass oil passage, the hydraulic oil being to flow from the first oil passage toward the second oil passage via the check valve, the hydraulic oil being prevented from flowing from the second oil passage toward the first oil passage via the check valve.

2. The hydraulic system according to claim 1, further comprising:

a hydraulic pump connected to the first oil passage to supply the hydraulic oil to the first control valve through the first oil passage.

3. The hydraulic system according to claim 1, further comprising:

a third hydraulic actuator; and a third control valve connected to the first oil passage, the third control valve being connected to the third hydraulic actuator to control the third hydraulic actuator, hydraulic oil returning from the third hydraulic actuator to the third control valve being to be supplied to the first control valve through the first oil passage.

4. The hydraulic system according to claim 1, further comprising;

a throttle provided in the bypass oil passage to reduce an amount of the hydraulic oil flowing in the bypass oil passage.

5. The hydraulic system according to claim 1, further comprising:

a fourth hydraulic actuator; and a fourth control valve connected to the fourth hydraulic actuator to control the fourth hydraulic actuator, the fourth control valve being provided between the first control valve and the second control valve in the second oil passage, the second oil passage including a first sub oil passage connecting the first control valve and the fourth control valve and a second sub oil passage connecting the fourth control valve and the second control valve, the fourth control valve having a discharge oil passage through which hydraulic oil returning from the fourth hydraulic actuator to the fourth control valve is to be discharged.

6. The hydraulic system according to claim 1, wherein the first control valve has a discharge oil passage to be connected to the second oil passage, the hydraulic oil returning from the first hydraulic actuator to the first control valve being to be discharged through the discharge oil passage.

7. A hydraulic system of a work machine, comprising:

a hydraulic pump to supply hydraulic oil;

a first hydraulic actuator;

a second hydraulic actuator;

a first control valve connected to the hydraulic pump and the first hydraulic actuator to control the first hydraulic actuator;

a second control valve connected to the second hydraulic actuator to control the second hydraulic actuator, the first control valve being provided between the hydraulic pump and the second control valve;

a second oil passage which connects the second control valve and the first hydraulic actuator via the first control valve and through which hydraulic oil returning from the first hydraulic actuator to the first control valve is to be supplied to the second control valve;

a discharge oil passage which is branched from the second oil passage and through which the hydraulic oil returning from the first hydraulic actuator is to be discharged; and a throttle provided in the discharge oil passage.

8. The hydraulic system according to claim 7, further comprising:

a first oil passage connecting the hydraulic pump and the first control valve; and a third oil passage connecting the first control valve and the second control valve, the third oil passage being separate from the first oil passage, the first control valve being switchable between a first set of flow paths and a second set of flow paths, the first set of flow paths including a flow path through which the hydraulic oil is to flow from the first oil passage to the third oil passage, the second set of flow paths including a first flow path through which the hydraulic oil is to flow from the first oil passage to the first hydraulic actuator, a second flow path through which the hydraulic oil is to flow from the first oil passage to the third oil passage, and a third flow path through which the hydraulic oil returning from the first hydraulic actuator is to flow to the second oil passage.

9. The hydraulic system according to claim 8, further comprising:

a first check valve provided between a merging part and a branching part in the second oil passage, the second oil passage merging with a fourth oil passage at the merging part, the discharge oil passage being branched from the second oil passage at the branching part, the hydraulic oil being to flow from the first control valve to the second control valve through the first check valve, the hydraulic oil being prevented from flowing from the second control valve to the first control valve.

10. The hydraulic system according to claim 9, wherein the first hydraulic actuator is a hydraulic cylinder to stretch and contract and has a first port through which the hydraulic oil is discharged when the first hydraulic actuator contracts and a second port through which the hydraulic oil is discharged when the first hydraulic actuator stretches; and the second oil passage has a first return oil passage which connects the first control valve and the first port of the first hydraulic actuator and through which the return oil discharged from the first port is to flow, an inner oil passage provided in the first control valve and communicating with the first return oil passage, and an outer oil passage communicating with the inner oil passage and connected to the second control valve.

11. The hydraulic system according to claim 10, wherein the first check valve is provided in the outer oil passage.

12. The hydraulic system according to claim 10, further comprising:

a second return oil passage which connects the second port of the first hydraulic actuator and the first control valve and through which the hydraulic oil discharged from the first port is to flow;

a fourth oil passage which is connected to the second return oil passage and through which the hydraulic oil is to be discharged; and a relief valve provided in the fourth oil passage.

* * * * *